US005356037A

United States Patent [19]

Harrold

[11] Patent Number: 5,356,037

[45] Date of Patent: Oct. 18, 1994

[54] LIFT AND DROP RATCHET STICK DISPENSER

[75] Inventor: John E. Harrold, Bloomsbury, N.J.

[73] Assignee: Pakmax, Inc., Bloomsbury, N.J.

[21] Appl. No.: 79,042

[22] Filed: Jun. 21, 1993

[51] Int. Cl.[5] ..... B65D 35/28

[52] U.S. Cl. ..... 222/95; 222/105; 222/326; 222/391; 401/145; 401/179

[58] Field of Search ..... 222/95, 105, 183, 325, 222/326, 386, 391; 401/145, 179

[56] References Cited

U.S. PATENT DOCUMENTS

| | | | |
|---|---|---|---|
| 2,086,462 | 7/1937 | Bost | 32/70 |
| 2,541,949 | 2/1951 | Thacker et al. | 15/137 |
| 2,872,034 | 2/1959 | Harris | 206/56 |
| 3,221,409 | 12/1965 | Thiel et al. | 32/60 |
| 3,977,574 | 8/1976 | Thomas | 222/391 |
| 4,318,499 | 3/1982 | Hamilton | 222/327 |
| 4,323,176 | 4/1982 | Sartain | 222/326 |
| 4,749,106 | 6/1988 | von Schuckmann et al. | 222/391 X |
| 4,763,815 | 8/1988 | von Schuckmann et al. | 222/391 X |

FOREIGN PATENT DOCUMENTS

| | | | |
|---|---|---|---|
| 3618399 | 12/1987 | Fed. Rep. of Germany | 222/391 |
| 3938433 | 5/1991 | Fed. Rep. of Germany | 222/391 |
| 2108208 | 5/1983 | United Kingdom | 222/386 |

*Primary Examiner*—Andres Kashnikow

*Assistant Examiner*—Joseph A. Kaufman

*Attorney, Agent, or Firm*—Kenneth P. Glynn

[57] ABSTRACT

The present invention is a dispenser for liquids or solids. It includes a main hollow housing with sidewalls, an open base and an open top. The base is open to receive an activator component and the top is at least partially open for dispensing material therethrough. There are also at least two sets of vertically aligned, horizontal housing ratchets located on the inside of the housing sidewalls. They are tapered downwardly so as to permit upward movement and restrict downward movement of a push plate located within the housing. There is also an activator component inserted into the bottom of the housing, which is reciprocally movable. It has at least two sets of vertically aligned horizontal ratchets extending upwardly and aligned against the inside of the housing sidewalls. The activator component has a flexible spring portion biasing the activator component downwardly. The activator component is reciprocally movable between a first, lower position and a second, higher position, such that when the activator component is moved from a first, lower position to a second, higher position, its ratchets move the push plate upwardly at least one ratchet length, and when the activator component is moved from the second position back to the first position, it is reset to advance the push plate upwardly upon a next reciprocation.

9 Claims, 3 Drawing Sheets

LIFT AND DROP RATCHET STICK DISPENSER

BACKGROUND OF THE INVENTION

1. Field of the Invention

The present invention is directed to dispensers and, more specifically, to vertical ratchet dispensers which are utilized to advance liquids, creams, pastes, cakes, bars and the like to move dispensing material out of the dispenser at rates and times desired by the user. More specifically, the present invention is directed to such dispensers which involve vertical ratcheting by utilization of a lift and drop ratcheting arrangement which functions to advance a push plate.

2. Prior Art Statement

Numerous ratcheting dispensers have been developed over the years and date back more than half a century. They have been developed for many purposes and have diverse mechanisms for operation. Additionally, various types of tubes and dispensers have been developed to advance cakes and pastes and bar materials such as underarm deodorant bars, lipstick bars, ski wax bars and the like.

U.S. Pat. No. 2,086,462 issued to David E. Bost describes a dispenser for discharging wax or other dispensing material by use of a vertical ratchet mechanism which has a squeeze trigger type handle member and various springs and mechanisms interconnected, including a clamping member and at least three pins or shafts and about six or seven separate pieces for the ratchet advancing mechanism.

U.S. Pat. No. 2,541,949 to Thacker et al describes a range dispenser and applicator with a ratchet-operated force feed system. In this technique, the ratchet moves vertically and does not reciprocate in place as in the present invention.

U.S. Pat. No. 2,872,034 describes a lipstick container which has a typical twist to advance mechanism.

U.S. Pat. No. 3,221,409 issued to Charles J. Thiel and Louis J. Michaels describes an amalgam dispenser which, again, utilizes a trigger type mechanism with spring, pins and a complex arrangement of components.

U.S. Pat. No. 3,977,574 describes a dispensing pipette actuator system. This system also utilizes a ratcheting mechanism in a vertical direction but requires at least two springs and six or seven components for the ratchet driving mechanism.

U.S. Pat. No. 4,318,499 issued to Joel A. Hamilton, describes a propulsion apparatus with a self contained handle for use with a removable cartridge. This involved movement of hinged, semi-flexible ratcheting members as well as a plurality of springs and pins.

U.S. Pat. No. 4,323,176 describes a manually operable ratchet type dispenser for comestibles which includes a vertical ratcheting mechanism with a handle. This requires at least three pins and four or five complex components.

Thus, notwithstanding the formidable prior art, there seems to be no teaching of the present invention which utilizes a single, semi-flexible component to perform the three functions of a trigger, of a ratcheting member to advance a ratchet column and of a return spring. Thus, separate from the advancing ratchet column itself, the present invention requires only two moving parts, no metal springs and no or minimal set pins.

SUMMARY OF THE INVENTION

The present invention is a dispenser for liquids or solids. It includes a main hollow housing with sidewalls, an open base and an open top. The base is open to receive an activator component and the top is at least partially open for dispensing material therethrough. There are also at least two sets of vertically aligned, horizontal housing ratchets located on the inside of the housing sidewalls. They are tapered downwardly so as to permit upward movement and restrict downward movement of a push plate located within the housing. There is also an activator component inserted into the bottom of the housing, which is reciprocally movable. It has at least two sets of vertically aligned horizontal ratchets extending upwardly and aligned against the inside of the housing sidewalls. The activator component has a flexible spring portion biasing the activator component downwardly. The activator component is reciprocally movable between a first, lower position and a second, higher position, such that when the activator component is moved from a first, lower position to a second, higher position, its ratchets move the push plate upwardly at least one ratchet length, and when the activator component is moved from the second position back to the first position, it is reset to advance the push plate upwardly upon a next reciprocation.

BRIEF DESCRIPTION OF THE DRAWINGS

The present invention will be more fully understood when the disclosure set forth in the specification herein is taken in conjunction with the drawings appended hereto. Those drawings are.

DETAILED DESCRIPTION OF THE PRESENT INVENTION

The present invention is directed to a ratchet dispenser which is superior to the prior art dispensers due to its particular construction and design as well as its unique function. The improvement of the present invention device involve elimination of metal springs, pins and a significant plurality of components for ratcheting, thus substantially decreasing the likelihood of breakage, simplifying construction and decreasing costs of manufacture.

The present invention dispensing device also eliminates the need for elongated telescoping mechanisms or posts used in push-ups and reduces the space requirements for the advancing mechanism.

Figure 1:
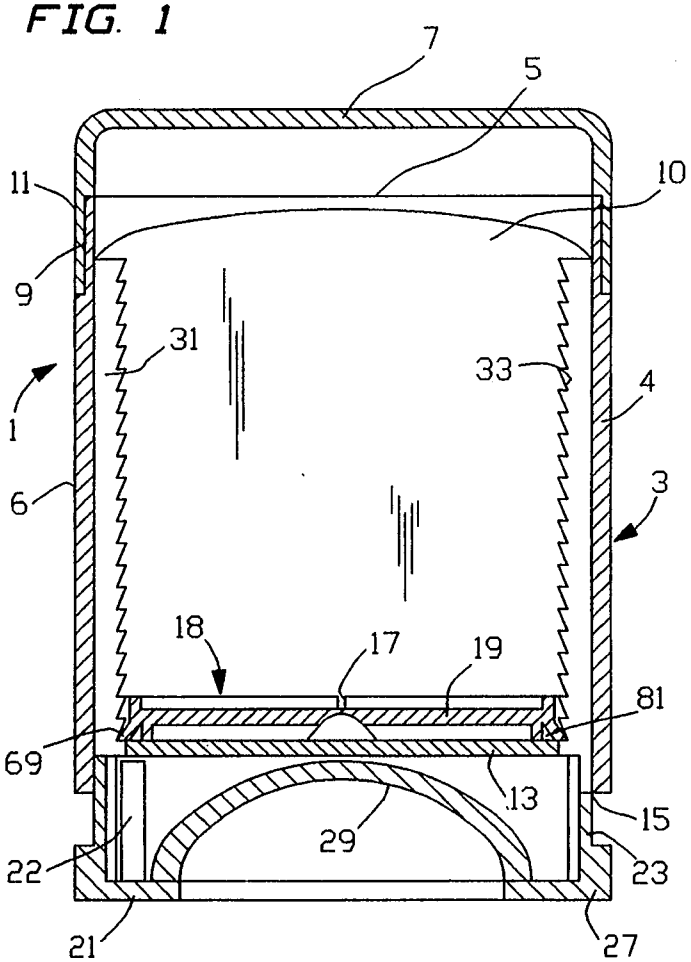
FIG. 1 shows a front cut view of a present invention lift and drop ratchet dispenser device.

Referring now to FIG. 1, there is shown a front cut view of present invention dispenser 1. Dispenser 1 includes a main hollow housing 3 which has sidewalls such as side walls 4 and 6, and an open bottom 15. Top 5 is fully open in this embodiment, as it has been developed for dispensing of stick materials such as deodorant stick 10. Extended wall portion 9 is adapted to receive lid 7, with collar 11, as shown. Also, divider 13 acts in conjunction with spring 29, discussed below.

At least two sets of vertically aligned, horizontal housing ratchets (not shown here, see Figures below) are located on the inside of housing sidewalls 4 and 6. They would be tapered downwardly so as to permit upward movement of push plate 18 and restrict downward movement.

Push plate 18 includes base 19, cut out 17 and prongs 69 and 81.

Activator component 21 acts as a reciprocating member and moves its vertically aligned horizontal ratchet sets 31 and 33 in a reciprocating fashion. Spring 29 pushes component 21 to a first, lower position. When a user pushes activator component upwardly, to a second, higher position, thin wall 23 stops when thicker wall 27 meets housing bottom 15 and limits the upward distance of actuator component to a predetermined distance to move push plate 18, for example, one or two distances upward, i.e. past one or two of the stationary ratchets of the sidewalls. When component 21 is released, spring 29 lowers it to its first position and it is reset for the next reciprocation. When it is returning from its second to its first position, push plate 18 remains at its higher level due to the one way feature of the ratchets. Optional stanchion 22 keeps push plate 18 from being originally set into housing 3 too low so that the push plate is not set in below the ratchets.

Figure 2:
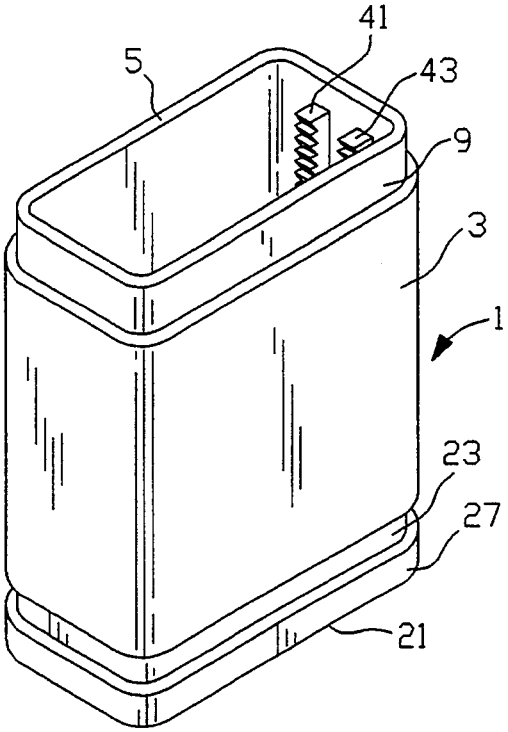
FIG. 2 shows a front perspective view of the present invention device shown in FIG. 1.
Figure 3:
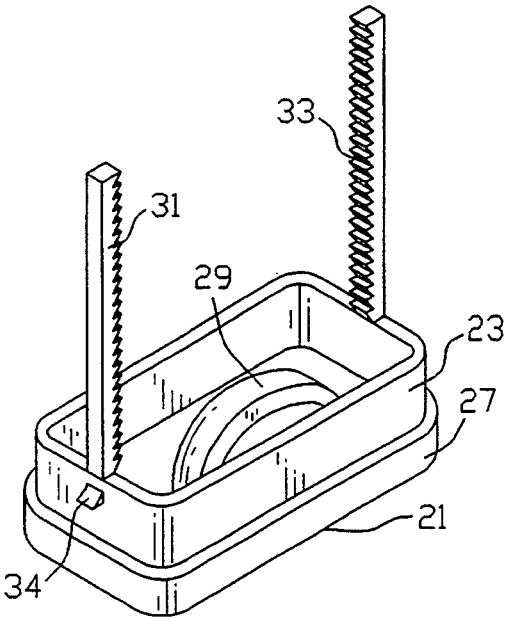
FIGS. 3 and 4 illustrate partial front perspective views of an activator component with ratchets and a housing with ratchets.
Figure 4:
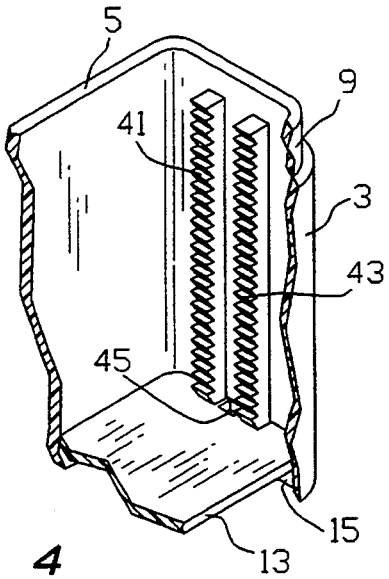

FIG. 2 shows a front perspective view of the FIG. 1 dispenser 1 and identical parts are identically numbered. Here housing sidewall ratchet sets 41 and 43 are shown. FIG. 3 shows a similar view of activator component 21, with ratchet sets 31 and 33 and stop 34. Otherwise, identical parts from FIG. 1 are identically numbered. Stop 34 functions to prevent removal of component 21 once it is inserted into housing 3. Ratchet sets 31 and 33 nest with housing ratchets sets. For example, referring to FIGS. 2, 3 and 4, it can be seen that ratchet set 33 will nest between housing ratchet sets 41 and 43 by being inserted upwardly through opening 45 (FIG. 4) and that spring 29 will be retained by divider 13.

In preferred embodiments, as shown, the activator component is unistructurally formed by being molded into one piece but may alternatively be an assemblage of two or more parts. However, there are significant manufacturing advantages achieved when unistructured molding is employed, including ease of manufacture, lower cost, fewer parts, less assemblage, less reject rate, etc.

Figure 5:
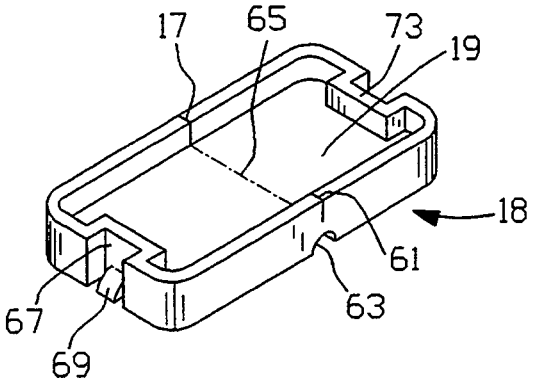
FIG. 5 shows a front perspective view of a push plate used in a present invention device.
Figure 6:
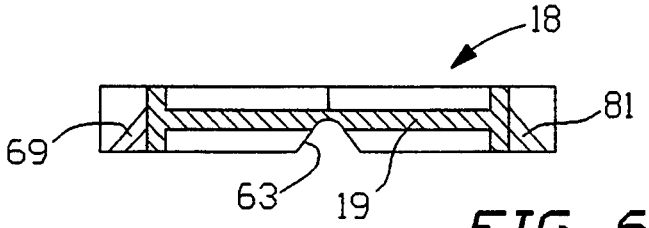
FIG. 6 illustrates a front cut view of the push plate of FIG. 6
Figure 7:
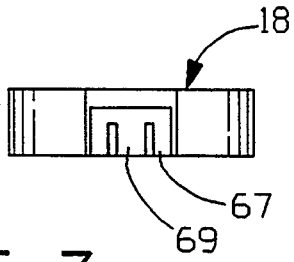
FIG. 7 shows an end view thereof.

FIGS. 5, 6 and 7 show front perspective, side cut and end views of push plate 18, with cut outs 17 and 61, and cut out 63, enabling push plate 18 to be folded downwardly. Also shown are ratcheting means, here prongs 69 and 81 at indents 67 and 73, perspectively. These enhance upward movement of push plate 18 and inhibit downward movement. Other ratcheting means, such as flat ends extending outwardly would be likewise be effective for enhancing upward and preventing downward movement, due to the downward tapers of the horizontal ratchets.

Figure 8:
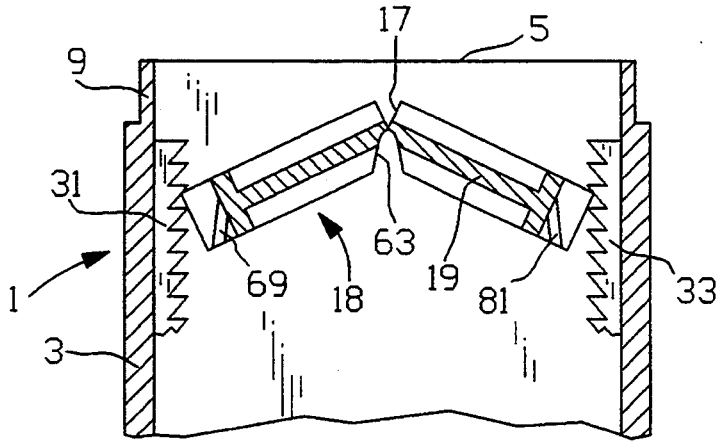
FIG. 8 shows a front cut view of a present invention dispenser device shown above, except that the push plate is partially folded and is being inserted into the dispenser device housing.

FIG. 8 shows a front cut partial view of housing 3 of dispenser 1 with push plate 18 being folded for insertion. While this is not required and force fit or pieced component assemblage could be used, folding push plate 18 as shown permits easy insertion. When lowered to the lowest ratchets and released, push plate 18 snaps open and nests prongs 69 and 81 onto ratchets for filling of the housing with cake material and subsequent use.

Figure 9:
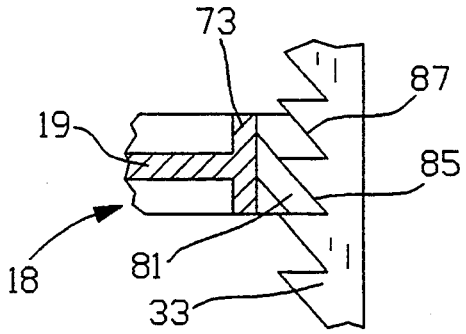
FIG. 9 shows a blown-up side cut view of one end of a housing and push plate.

FIG. 9 shows a blow up of ratchet set 33 and the right end of push plate 18. As can now be seen, prong 81 will flex in as push plate 18 is moved up, but will rest on a horizontal ratchet to prevent downward movement of push plate 18 as activator component ratchet set 33 with ratchets 85 and 87 moves downwardly.

Figure 10:
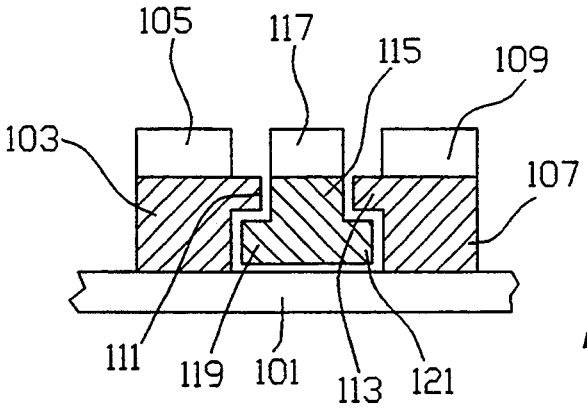
FIG. 10 shows a top cut view of an alternative embodiment ratchet arrangement; and, FIG. 11 shows a front cut view of an alternative embodiment present invention dispensing device for liquids.

FIG. 10 shows a top cut partial view of housing 101 with housing ratchet sets 103 and 107 with ratchets 105 and 109, as shown. Here, the ratchet sets 103 and 107 have flanges 111 and 113. Activator component ratchet set 115 with ratchet 117. Wings 119, and 121 of ratchet set 115 nests within flange 111 and 113 so as to enhance the ease of motion of reciprocating ratchet set 115 and to increase the strength of the structure, e.g. by preventing bending or flexing of ratchet set 115.

Figure 11:
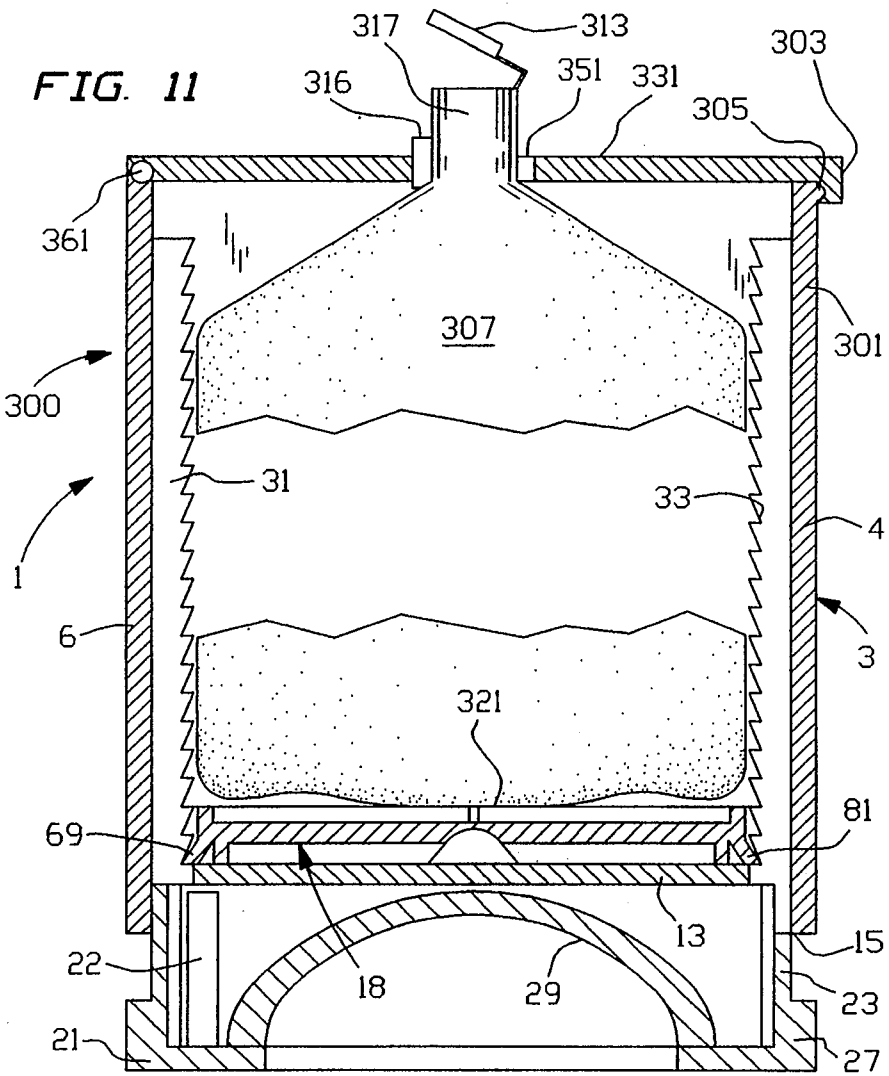

Referring now to FIG. 11 there is shown a front cut view of an alternative embodiment present invention dispenser 300. In FIG. 11, the activator component 21 is the same as in FIG. 1, as are other aspects, and all identical parts are identically numbered.

In this embodiment, as the activator component 21 is vertically reciprocated, tapered push plate 18 advances against the base 321 of pouch 307 so as to push upwardly and squeeze material out of pouch 307. Cap 313 is shown as a snap cap but may be a screw cap or otherwise. Additionally, top orifice 351 may be notched so as to receive stop 316 and enable pouch 307 to be maintained in a fixed position. The notch may be tapered so as to limit downward movement of neck 351 or, alternatively, neck 317 could have a lip or ledge or any other mechanism might be used as long as there would be some way to rotate and remove or otherwise pull pouch 307 away from top 331 when top 331 is removed. For example, it might be that neck 317 would have to be lifted upwardly and then lowered down through orifice 351 provided that there were adequate clearances. Note that top 331 has a hinge member 361 as well as a latching means 303 which connects to male latch portion 305 to maintain top 331 in a closed position. However, it can be seen that with adequate force, top 331 could be removed and pouch 307 replaced with a new supply of material. Additionally, dispenser 300 could have a larger pouch capability so that more than 60 or 70 percent of the space could contain pouch volume so as to provide a larger supply of dispensing material relative to the size of the dispenser itself.

Obviously, numerous modifications and variations of the present invention are possible in light of the above teachings. It is therefore understood that within the scope of the appended claims, the invention may be practiced otherwise than as specifically described herein.

What is claimed is:

1. A dispenser, comprising:

(a) a main hollow housing having an inside and an outside and having sidewalls, a base and a top, said base being open to receive an activator component and said top being at least partially open for dispensing material therethrough;

(b) at least two sets of vertically aligned, horizontal housing ratchets located on the inside of said housing sidewalls, said ratchets being tapered downwardly so as to permit upward movement and restrict downward movement;

(c) a push plate located within said housing and adapted so as to only be movable upwardly past said housing ratchets;

(d) an activator component inserted into the bottom of said housing, said activator component being vertically and reciprocally movable within said housing, and having at least two sets of vertically aligned horizontal ratchets extending upwardly and aligned against the inside of said housing sidewalls, said ratchets being tapered downwardly so as to permit upward movement of said push plate, said activator component having a flexible spring portion biasing said activator component downwardly, whereby said activator component is reciprocally movable between a first, lower position and a second, higher position such that when said activator component is moved from a first, lower position to a second, higher position, its ratchets move said push plate upwardly at least one ratchet length, and when said activator component is moved from said second position back to said first position, it is reset to advance said push plate upwardly upon a next reciprocation.

2. The dispenser of claim 1 wherein said top of said housing is open sufficiently to dispense a cake material and said push plate includes means for holding a portion of a cake material therein.

3. The dispenser of claim 1 wherein said top of said housing has a dispensing orifice adapted to receive a neck of a material pouch.

4. The dispenser of claim 3 further including a dispensing pouch having a neck and compressible body, said pouch neck being located in said orifice of the top of said housing.

5. The dispenser of claim 1 wherein said push plate is partially bifurcated to enhance its insertion into said housing and to enable reusing of said push plate.

6. The dispenser of claim 10 wherein said at least two sets of vertically aligned, horizontal housing ratchets is four sets of vertically aligned, horizontal housing ratchets and they are located in opposite pairs such that the activator component ratchets nest therebetween.

7. The dispenser of claim 6 wherein said activator component includes a wider lower portion which extends beyond the bottom of said housing to create a vertical handle for a user.

8. The dispenser of claim 1 wherein said activator component also includes a stanchion to prevent accidental overinsertion of said push plate.

9. The dispenser of claim 1 wherein said activator component ratchets are flanged and said housing ratchets are winged to receiver said flanges so as to enhance the reciprocal functioning and strength of the device.

* * * * *